US011555385B2

(12) United States Patent
Ursi et al.

(10) Patent No.: US 11,555,385 B2
(45) Date of Patent: Jan. 17, 2023

(54) ORIENTING SUB

(71) Applicant: Oso Perforating, LLC, Irving, TX (US)

(72) Inventors: Jeremy Ursi, Frisco, TX (US); Daniel Schmidt, Moore, OK (US); Tobias Hartman, Frisco, TX (US)

(73) Assignee: OSO PERFORATING, LLC, Irving, TX (US)

( * ) Notice: Subject to any disclaimer, the term of this patent is extended or adjusted under 35 U.S.C. 154(b) by 21 days.

(21) Appl. No.: 17/193,412

(22) Filed: Mar. 5, 2021

(65) Prior Publication Data

US 2021/0277753 A1 Sep. 9, 2021

Related U.S. Application Data

(60) Provisional application No. 62/986,476, filed on Mar. 6, 2020.

(51) Int. Cl.

| | |
|---|---|
| ***E21B 17/02*** | (2006.01) |
| ***E21B 17/043*** | (2006.01) |
| ***E21B 43/116*** | (2006.01) |
| ***E21B 43/119*** | (2006.01) |

(52) U.S. Cl.

CPC ..... *E21B 43/119* (2013.01); *E21B 17/028* (2013.01); *E21B 17/043* (2013.01); *E21B 43/116* (2013.01)

(58) Field of Classification Search

CPC .... E21B 17/028; E21B 17/043; E21B 43/116; E21B 43/119

See application file for complete search history.

(56) References Cited

U.S. PATENT DOCUMENTS

| | | | | |
|---|---|---|---|---|
| 3,923,105 | A | 12/1975 | Lands, Jr. | |
| 4,554,976 | A * | 11/1985 | Hynes | E21B 17/06 166/85.4 |
| 8,591,205 | B2 * | 11/2013 | Brown | F04B 17/03 417/423.6 |
| 2005/0022999 | A1 * | 2/2005 | Hughes | F16L 25/01 166/380 |
| 2005/0155770 | A1 * | 7/2005 | Parrott | E21B 43/11 166/242.6 |
| 2005/0229805 | A1 | 10/2005 | Myers, Jr. et al. | |
| 2005/0279513 | A1 * | 12/2005 | Eppink | E21B 17/10 166/380 |
| 2007/0034381 | A1 | 2/2007 | Campbell et al. | |
| 2019/0063649 | A1 | 2/2019 | Snyder, II | |
| 2019/0257158 | A1 | 8/2019 | Langford et al. | |
| 2021/0277753 | A1 * | 9/2021 | Ursi | E21B 43/119 |

FOREIGN PATENT DOCUMENTS

GB 2428708 A 2/2007

OTHER PUBLICATIONS

International Search Report and Written Opinion for corresponding International Application No. PCT/US2021/021152, dated May 20, 2021; 11 pages.

* cited by examiner

*Primary Examiner* — Daniel P Stephenson

(74) *Attorney, Agent, or Firm* — Haynes and Boone, LLP

(57) ABSTRACT

An orienting sub including a hub retainer, a gun sleeve, a locking sleeve, and an electric conductor assembly. In several embodiments, the orienting sub couples a first perforating gun to a second perforating gun. The first perforating gun, the second, perforating gun, and the orienting sub may together form a well perforating system for perforating a wellbore that traverses a subterranean oil and gas formation.

24 Claims, 8 Drawing Sheets

ORIENTING SUB

CROSS-REFERENCE TO RELATED APPLICATION

This application claims the benefit of the filing date of, and priority to, U.S. Application No. 62/986,476, filed Mar. 6, 2020, the entire disclosure of which is hereby incorporated herein by reference.

BACKGROUND

The present application relates generally to orienting subs used in oil and gas operations and, more particularly, to an orienting sub that is part of a wellbore perforating system.

DETAILED DESCRIPTION

Figure 1:
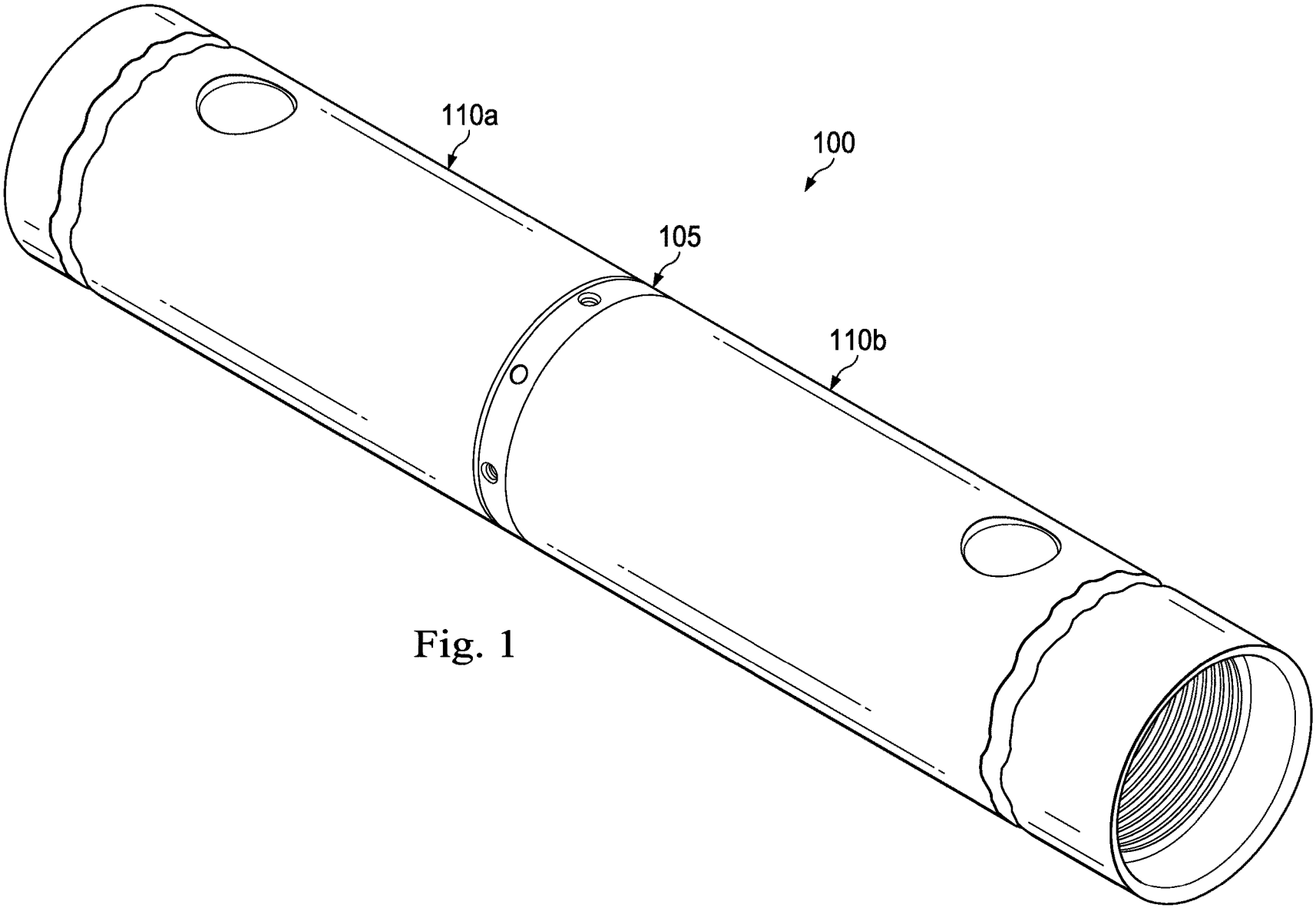
FIG. 1 is a perspective view of a wellbore perforating system, according to one or more embodiments.

Referring to FIG. 1, a perspective view of a wellbore perforating system 100 is illustrated according to an embodiment of the present disclosure. The wellbore perforating system 100 includes an orienting sub 105, a perforating gun 110*a* coupled to the orienting sub 105, and a perforating gun 110*b* coupled to the orienting sub 105, opposite the perforating gun 110*a*.

Figure 2:
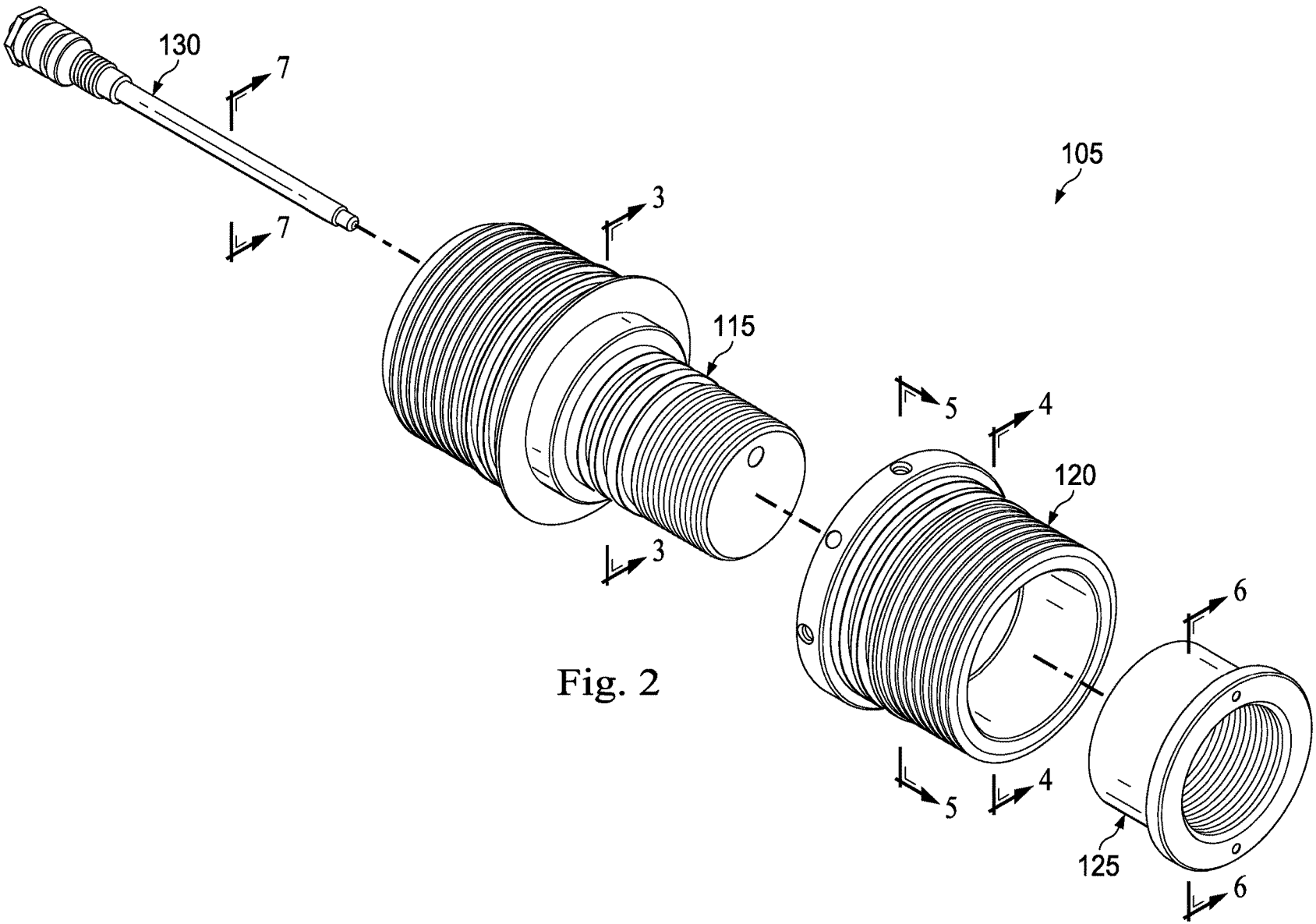
FIG. 2 is an exploded perspective view of an orienting sub of FIG. 1 wellbore perforating system, according to one or more embodiments.

Referring to FIG. 2, with continuing reference to FIG. 1, an exploded perspective view of the orienting sub 105 is illustrated according to an embodiment of the present disclosure. The orienting sub 105 includes a hub retainer 115, a gun sleeve 120, a locking sleeve 125, and an electric conductor assembly 130.

Figure 3:
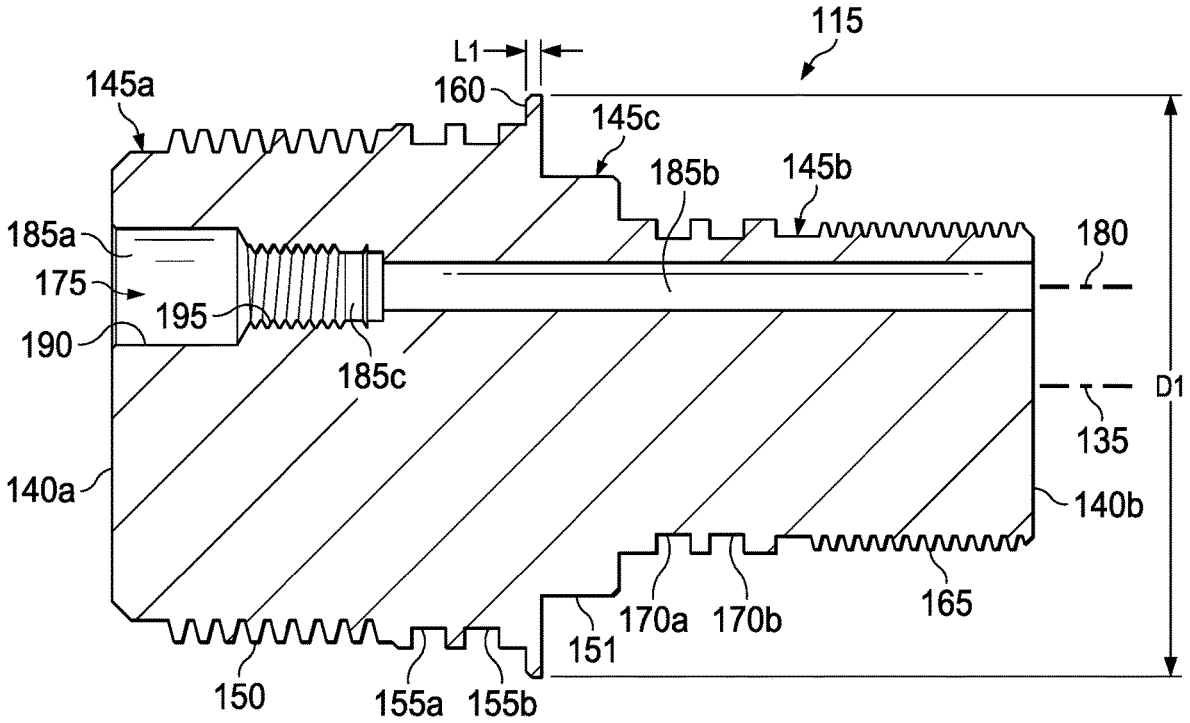
FIG. 3 is a cross-sectional view of a hub retainer of FIG. 2 orienting sub taken along the line 3-3 in FIG. 2, according to one or more embodiments.

Referring to FIG. 3, with continuing reference to FIG. 2, a cross-sectional view of the hub retainer 115 of the orienting sub 105 taken along the line 3-3 of FIG. 2 is illustrated according to an embodiment of the present disclosure. The hub retainer 115 extends along a central axis 135 and defines opposing end portions 140*a* and 140*b*. The hub retainer 115 includes an enlarged-diameter portion 145*a*, a reduced-diameter portion 145*b*, and an intermediate-diameter portion 145*c*. The enlarged-diameter portion 145*a* of the hub retainer 115 extends proximate the end portion 140*a*. An external threaded connection 150 is formed in the enlarged-diameter portion 145*a* of the hub retainer 115 proximate the end portion 140*b*. The intermediate-diameter portion 145*c* of the hub retainer 115 defines a setting surface 151 and extends between the enlarged-diameter portion 145*a* and the reduced-diameter portion 145*b*. External annular grooves 155*a* and 155*b* are formed in the hub retainer 115 axially between the external threaded connection 150 and the intermediate-diameter portion 145*c* of the hub retainer 115. Although shown with the external annular grooves 155*a* and 155*b* in FIG. 3, a different number of external annular grooves may instead be formed in the hub retainer 115 axially between the external threaded connection 150 and the intermediate-diameter portion 145*c* of the hub retainer 115, such as, for example, one external annular groove, three external annular grooves, or more. An external annular collar 160 extends outwardly from the enlarged-diameter portion 145*a* of the hub retainer 115 axially between the external annular grooves 155*a* and 155*b* and the intermediate-diameter portion 145*c* of the hub retainer 115. The collar 160 extending outwardly from the enlarged-diameter portion 145*a* of the hub retainer 115 has an axial length L1 and an outer diameter D1.

The reduced-diameter portion 145*b* of the hub retainer 115 extends proximate the end portion 140*b*. An external threaded connection 165 is formed in the reduced-diameter portion 145*b* of the hub retainer 115 proximate the end portion 140*b*. External annular grooves 170*a* and 170*b* are formed in the hub retainer 115 axially between the external threaded connection 165 and the intermediate-diameter portion 145*c* of the hub retainer 115. Although shown with the external annular grooves 170*a* and 170*b* in FIG. 3, a different number of external annular grooves may instead be formed in the hub retainer 115 axially between the external threaded connection 165 and the intermediate-diameter portion 145*c* of the hub retainer 115, such as, for example, one external annular groove, three external annular grooves, or more.

An internal passageway 175 is formed through the hub retainer 115 along a central axis 180. The central axis 180 along which the internal passageway 175 extends is spaced apart from the central axis 135 along which the hub retainer 115 extends. In several embodiments, the central axis 180 along which the internal passageway 175 extends and the central axis 135 along which the hub retainer 115 extends are spaced apart in a parallel relation. The internal passageway 175 formed through the hub retainer 115 includes an enlarged-diameter portion 185*a*, a reduced-diameter portion 185*b*, and an intermediate-diameter portion 185*c*. The enlarged-diameter portion 185*a* of the internal passageway 175 extends proximate the end portion 140*a* of the hub retainer 115. An internal sealing surface 190 is formed in the hub retainer 115 adjacent the enlarged-diameter portion 185*a* of the internal passageway 175. The reduced-diameter portion 185*b* of the internal passageway 175 extends proximate the end portion 140*b* of the hub retainer 115. The intermediate-diameter portion 185*c* of the internal passageway 175 extends between the enlarged-diameter portion 185*a* and the reduced-diameter portion 185*b*. An internal threaded connection 195 is formed in the hub retainer 115 adjacent the intermediate-diameter portion 185*c* of the internal passageway 175. In several embodiments, as in FIG. 3, the hub retainer 115 of the orienting sub 105 is "port-less", that is, the hub retainer 115 is devoid of any openings extending radially from the interior passage 175 to an exterior of the hub retainer 115.

Figure 4:
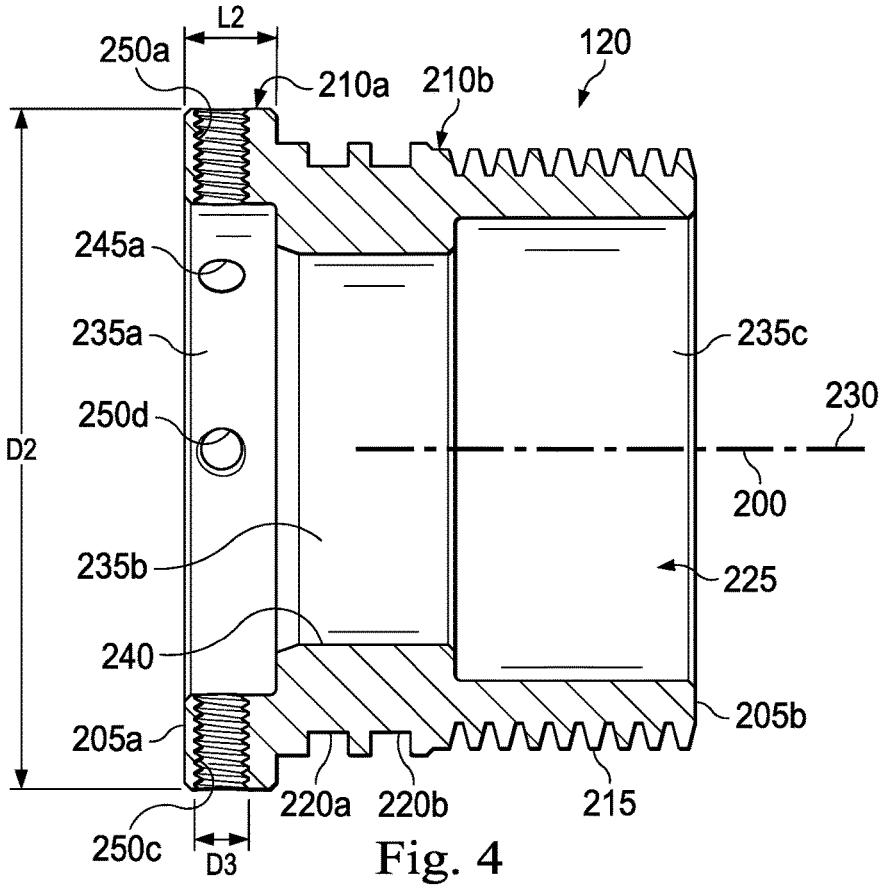
FIG. 4 is a cross-sectional view of a gun sleeve of FIG. 2 orienting sub taken along the line 4-4 in FIG. 2, according to one or more embodiments.

Referring to FIG. 4, with continuing reference to FIG. 2, a cross-sectional view of the gun sleeve 120 of the orienting sub 105 taken along the line 4-4 of FIG. 2 is illustrated according to an embodiment of the present disclosure. The gun sleeve 120 extends along a central axis 200 and defines opposing end portions 205*a* and 205*b*. The gun sleeve 120 includes an enlarged-diameter portion 210*a* and a reduced-diameter portion 210*b*. The enlarged-diameter portion 210*a* extends proximate the end portion 205*a* of the gun sleeve 120. In addition, the enlarged-diameter portion 210*a* of the gun sleeve 120 has an axial length L2 and an outer diameter D2. The reduced-diameter portion 210*b* extends proximate the end portion 205*b* of the gun sleeve 120. An external threaded connection 215 is formed in the reduced-diameter portion 210*b* of the gun sleeve 120 proximate the end portion 205*b*. External annular grooves 220*a* and 220*b* are formed in the gun sleeve 120 axially between the external threaded connection 215 and the enlarged-diameter portion 210*a* of the gun sleeve 120. Although shown with the external annular grooves 220*a* and 220*b* in FIG. 3, a different number of external annular grooves may instead be formed in the gun sleeve 120 axially between the external threaded connection 215 and the enlarged-diameter portion 210*a* of the gun sleeve 120, such as, for example, one external annular groove, three external annular grooves, or more.

An internal passageway 225 is formed through the gun sleeve 120 along a central axis 230. The central axis 230 along which the internal passageway 225 extends is coaxial with the central axis 200 along which the gun sleeve 120 extends. The internal passageway 225 formed through the gun sleeve 120 includes an enlarged-diameter portion 235*a*, a reduced-diameter portion 235*b*, and an enlarged-diameter portion 235*c*. The enlarged-diameter portion 235*a* of the internal passageway 225 extends proximate the end portion 205*a* of the gun sleeve 120. The enlarged-diameter portion 235*c* of the internal passageway 225 extends proximate the end portion 205*b* of the gun sleeve 120. The reduced-diameter portion 235*b* of the internal passageway 225 extends between the enlarged-diameter portion 235*a* and the enlarged-diameter portion 235*c*. An internal sealing surface 240 is formed in the gun sleeve 120 adjacent the reduced-diameter portion 235*b* of the internal passageway 225.

Figure 5:
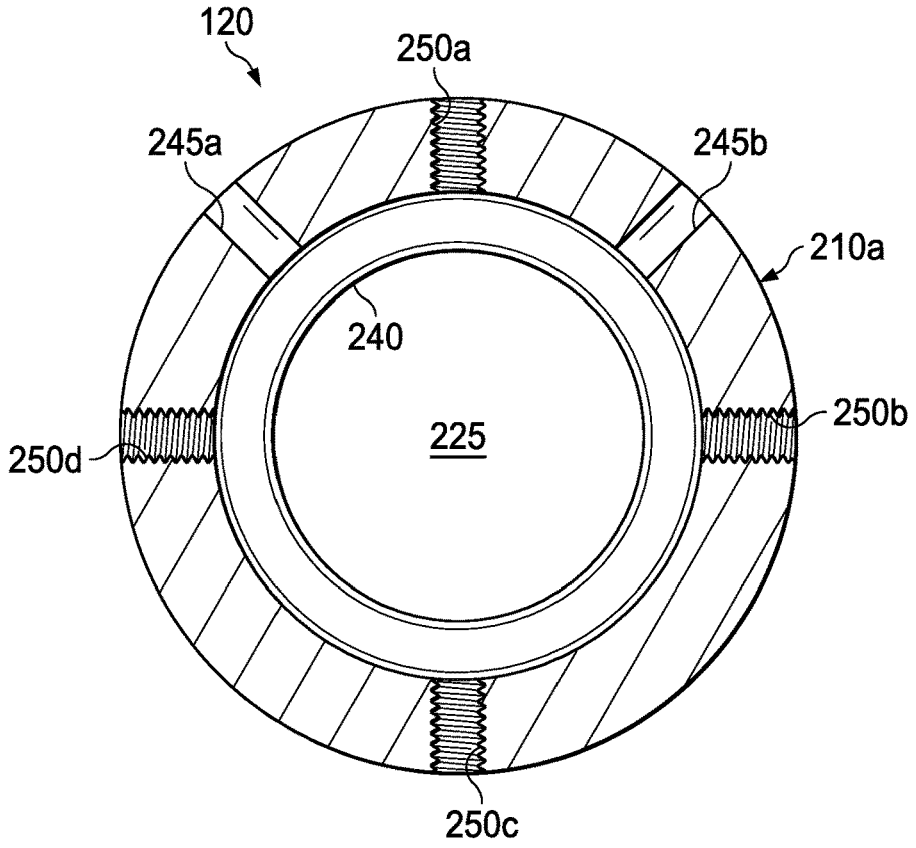
FIG. 5 is a cross-sectional view of the gun sleeve of FIG. 2 orienting sub taken along the line 5-5 in FIG. 2, according to one or more embodiments.

Referring to FIG. 5, with continuing reference to FIG. 4, a cross-sectional view of the gun sleeve 120 of the orienting sub 105 taken along the line 5-5 of FIG. 2 is illustrated according to an embodiment of the present disclosure. Spanner holes 245*a* and 245*b* are formed radially in the enlarged-diameter portion 210*a* of the gun sleeve 120. The spanner holes 245*a* and 245*b* are adapted to be engaged by a spanner wrench to facilitate assembly of the of the wellbore perforating system 100. Threaded holes 250*a-d* are also formed radially through the enlarged-diameter portion 210*a* and circumferentially distributed (e.g., evenly) around the gun sleeve 120. The threaded holes 250*a-d* are adapted to accommodate set screws 255*a-d* (shown in FIG. 9A), respectively, to facilitate assembly of the of the wellbore perforating system 100. Each of the threaded holes 250*a-d* has an inner diameter D3.

As shown if FIG. 5, the spanner hole 245*a* is located circumferentially between the threaded holes 250*a* and 250*d* and the spanner hole 245*b* is located circumferentially between the threaded holes 250*a* and 250*b*. Alternatively, the spanner holes 245*a* and 245*b* may be located elsewhere on the enlarged-diameter portion 210*a* or formed in another portion of the gun sleeve 120 (e.g., the reduced-diameter portion 210*b* of the gun sleeve 120). Furthermore, although shown with the threaded holes 250*a-d* in FIG. 5, any number of threaded holes may instead be formed radially through the enlarged-diameter portion 210*a* and circumferentially distributed (e.g., evenly) around the gun sleeve 120, such as, for example, one threaded hole, two threaded holes, three threaded holes, five threaded holes, or more.

Figure 6:
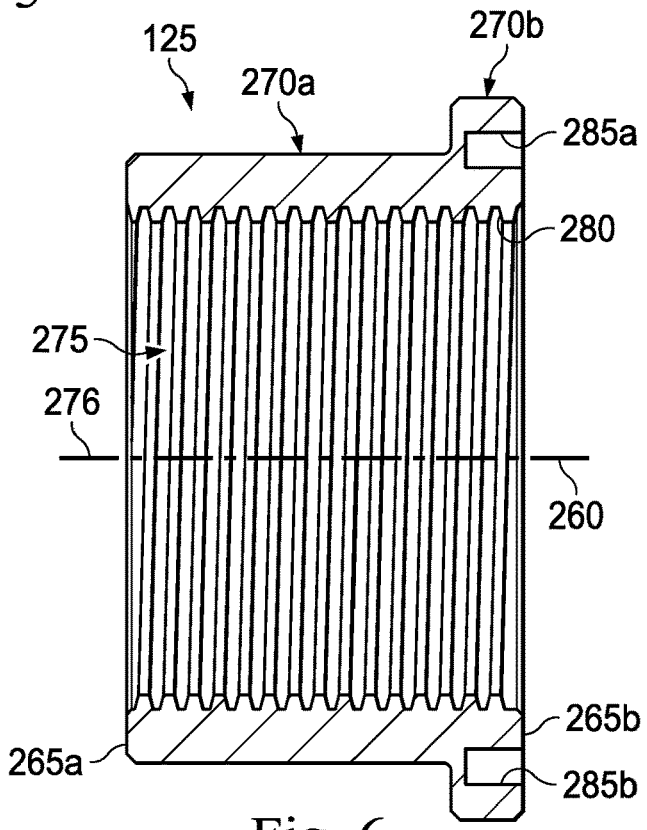
FIG. 6 is a cross-sectional view of a locking sleeve of FIG. 2 orienting sub taken along the line 6-6 in FIG. 2, according to one or more embodiments.

Referring to FIG. 6, with continuing reference to FIG. 2, a cross-sectional view of the locking sleeve 125 of the orienting sub 105 taken along the line 6-6 of FIG. 2 is illustrated according to an embodiment of the present disclosure. The locking sleeve 125 extends along a central axis 260 and defines opposing end portions 265*a* and 265*b*. The locking sleeve 125 includes a reduced-diameter portion 270*a* and an enlarged-diameter portion 270*b*. The reduced-diameter portion 270*a* extends proximate the end portion 265*a* of the locking sleeve 125. The enlarged-diameter portion 270*b* extends proximate the end portion 265*b* of the locking sleeve 125. An internal passageway 275 is formed through the locking sleeve 125 along a central axis 276. The central axis 276 along which the internal passageway 275 extends is coaxial with the central axis 260 along which the locking sleeve 125 extends. An internal threaded connection 280 is formed in the locking sleeve 125 adjacent the internal passageway 275. Spanner holes 285*a* and 285*b* are formed axially in the enlarged-diameter portion 270*b* of the locking sleeve 125. The spanner holes 285*a* and 285*b* are adapted to be engaged by a spanner wrench to facilitate assembly of the of the wellbore perforating system 100.

Figure 7:
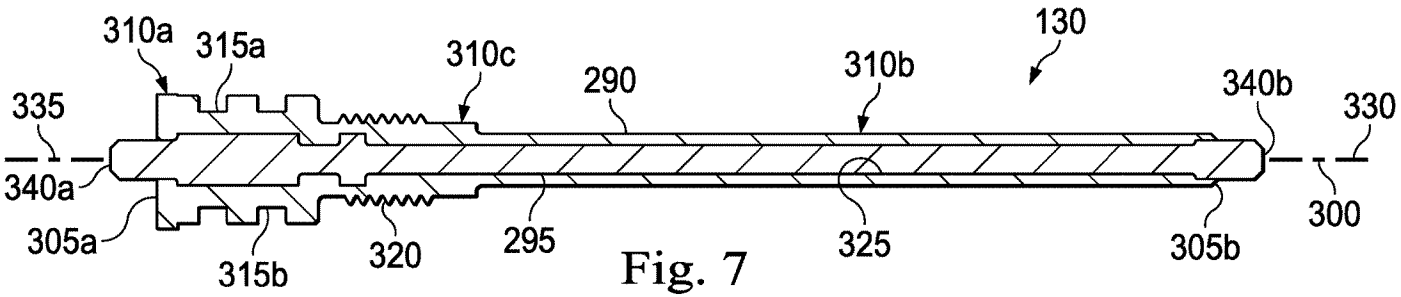
FIG. 7 is a cross-sectional view of an electrical conductor assembly of FIG. 2 orienting sub taken along the line 7-7 in FIG. 2, according to one or more embodiments.

Referring to FIG. 7, with continuing reference to FIG. 2, a cross-sectional view of the electric conductor assembly 130 of the orienting sub 105 taken along the line 7-7 of FIG. 2 is illustrated according to an embodiment of the present disclosure. The electric conductor assembly 130 includes a housing 290 and an electric conductor 295. The housing 290 extends along a central axis 300 and defines opposing end portions 305*a* and 305*b*. The housing 290 includes an enlarged-diameter portion 310*a*, a reduced-diameter portion 310*b*, and an intermediate-diameter portion 310*c*. The enlarged-diameter portion 310*a* of the housing 290 extends proximate the end portion 305*a*. External annular grooves 315*a* and 315*b* are formed in the enlarged-diameter portion 310*a* of housing 290 proximate the end portion 305*a*. Although shown with the external annular grooves 315*a* and 315*b* in FIG. 7, a different number of external annular grooves may instead be formed in the enlarged-diameter portion 310*a* of housing 290 proximate the end portion 305*a*, such as, for example, one external annular groove, three external annular grooves, or more. The reduced-diameter portion 310*b* of the housing 290 extends proximate the end portion 305*b*. The intermediate-diameter portion 310*c* of the housing 290 extends between the enlarged-diameter portion 310*a* and the reduced-diameter portion 310*b*. An external threaded connection 320 is formed in the intermediate-diameter portion 310*c* of the housing 290.

An internal passageway 325 is formed through the housing 290 along a central axis 330. The central axis 330 along which the internal passageway 325 extends is coaxial with the central axis 300 along which the housing 290 extends. The electric conductor 295 extends along a central axis 335 and defines opposing end portions 340*a* and 340*b*. The internal passageway 325 formed through the housing 190 accommodates the electric conductor 295 so that: the central axis 335 along which the electric conductor 295 extends is coaxial with the central axes 300 and 330; the end portion 340*a* of the electric conductor 295 to extend axially out of the internal passageway 325 and beyond the end portion 305*a* of the housing 190; and the end portion 340*b* of the electric conductor 295 to extend axially out of the internal passageway 325 and beyond the end portion 305*b* of the housing 190. In several embodiments, as in FIG. 7, the internal passageway 325 has a diameter that varies along its length defining various internal features in the housing 190, which internal features in the housing 190 matingly engage corresponding external features of the electric conductor 295 to thereby maintain the electric conductor 295 within the housing 290.

Figure 8:
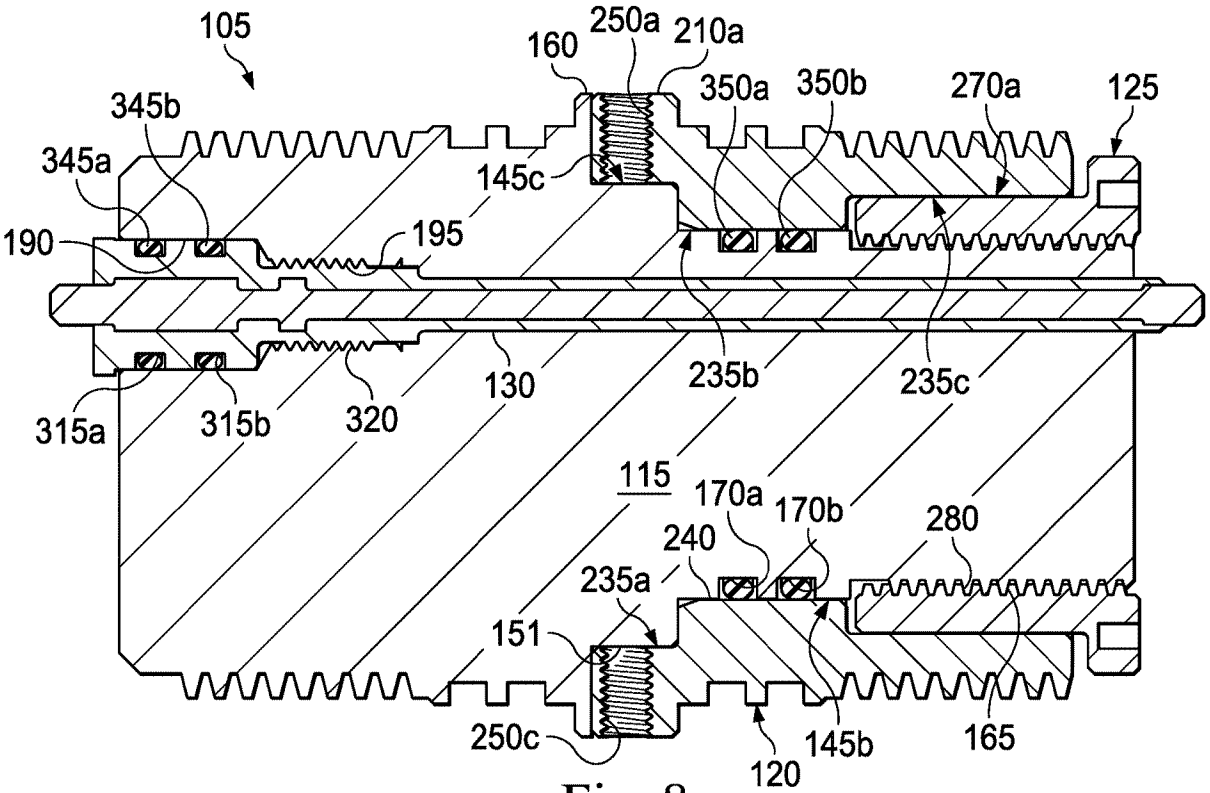
FIG. 8 is a cross-sectional view of FIG. 2 orienting sub, according to one or more embodiments.

Referring to FIG. 8, with continuing reference to FIGS. 1-7, a cross-sectional view of the orienting sub 105 in an assembled state is illustrated according to an embodiment of the present disclosure. The internal threaded connection 195 of the hub retainer 115 is threadably engaged with the external threaded connection 320 of the electric conductor assembly 130. Annular seals 345*a* and 345*b* are accommodated in the external annular grooves 315*a* and 315*b* of the electric conductor assembly 130, which annular seals 345*a* and 345*b* sealingly engage the internal sealing surface 190 of the hub retainer 115. In several embodiments, the electric conductor assembly 130 allows the hub retainer 115 of the orienting sub 105 to be port-less by providing a "solid state integrated feedthrough conductor" (i.e., the electric conductor 295) axially fixed within, and extending through, the internal passageway 175 of the hub retainer 115.

The intermediate-diameter portion 145*c* of the hub retainer 115 is received within the enlarged-diameter portion 235*a* of the internal passage 225 of the gun sleeve 120 so that: the threaded holes 250*a-d* in the gun sleeve 120 are aligned with the setting surface 151 of the hub retainer 115; and the enlarged-diameter portion 210*a* of the gun sleeve 120 engages (or nearly engages) the collar 160 extending outwardly from the enlarged-diameter portion 145*a* of the hub retainer 115. The reduced-diameter portion 145*b* of the hub retainer 115 extends through the reduced-diameter portion 235*b* of the internal passage 225 of the gun sleeve 120. Annular seals 350*a* and 350*b* are accommodated in the external annular grooves 170*a* and 170*b* of the hub retainer 115, which annular seals 350*a* and 350*b* sealingly engage the internal sealing surface 240 of the gun sleeve 120. The internal threaded connection 280 of the locking sleeve 125 is threadably engaged with the external threaded connection 165 of the hub retainer 115 so that the reduced-diameter portion 270*a* of the locking sleeve 125 is received within the enlarged-diameter portion 235*c* of the internal passage 225 of the gun sleeve 120. In several embodiments, the spanner holes 285*a* and 285*b* are engaged by a spanner wrench to facilitate the threaded engagement of the internal threaded connection 280 of the locking sleeve 125 with the external threaded connection 165 of the hub retainer 115. In this position, the locking sleeve 125 retains the gun sleeve 120 on the hub retainer 115 while, at the same time, permitting relative rotation between the gun sleeve 120 and the hub retainer 115.

Figure 9A:
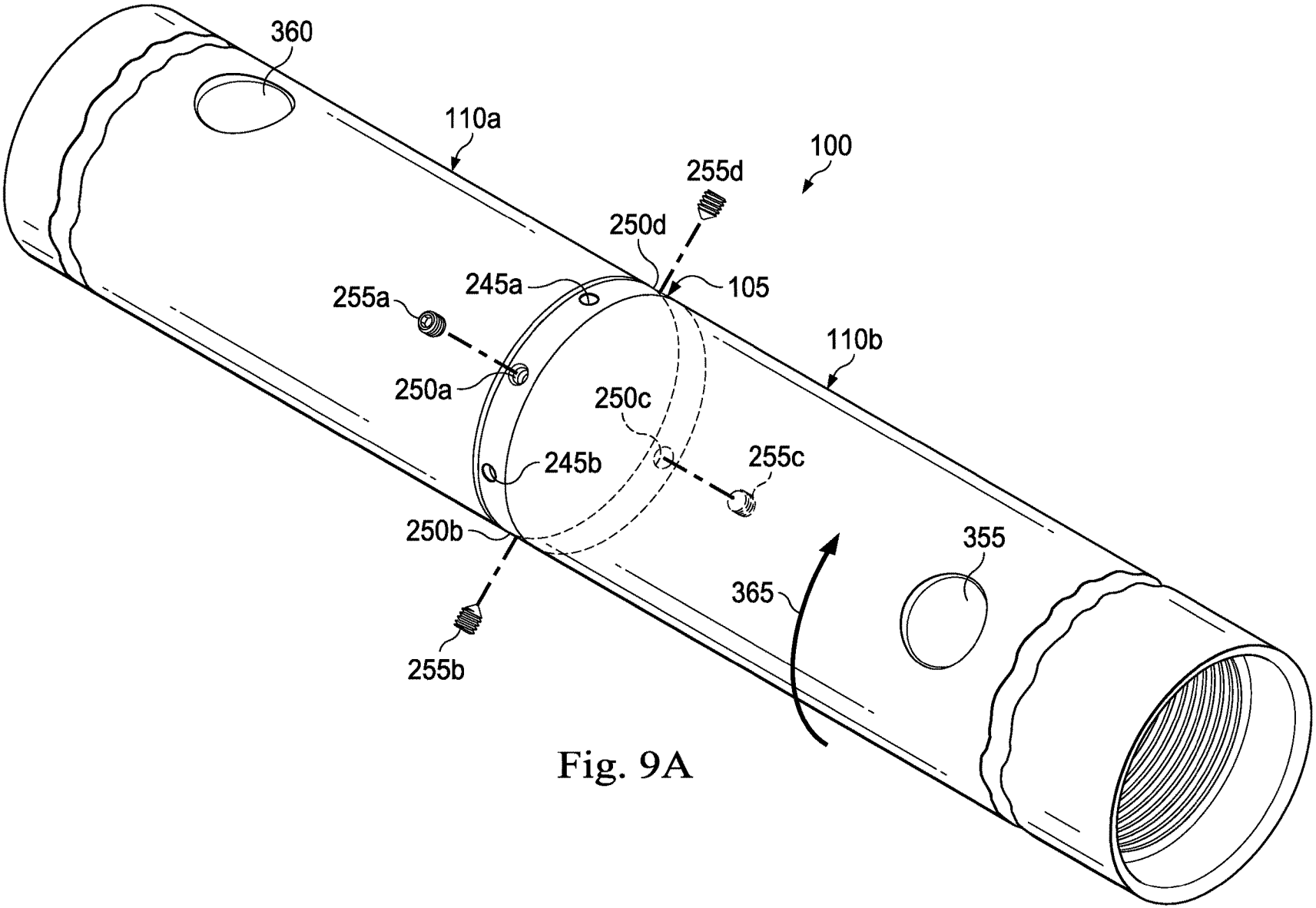
FIG. 9A is a perspective view of FIG. 1 wellbore perforating system in a first operational state or configuration, according to one or more embodiments.

Referring to FIG. 9A, with continuing reference to FIGS. 1-8, a perspective view of the wellbore perforating system 100 in a first operational state or configuration is illustrated according to an embodiment of the present disclosure. In the first operational state or configuration: the perforating gun 110*a* is connected to orienting sub 105 at the hub retainer 115, as will be described in further detail below in connection with FIG. 9C; the perforating gun 110*b* is connected to the orienting sub 105 at the gun sleeve 120, as will be described in further detail below in connection with FIG. 9C; a scallop recess 355 of the perforating gun 110*b* is circumferentially offset from a scallop recess 360 of the perforating gun 110*a*; and the set screws 255*a-d* are not tightened into the threaded holes 250*a-d*, respectively. Because of the set screws 255*a-d* not being tightened into the threaded holes 250*a-d*, respectively, in the first operational state or configuration, the orienting sub 105 permits relative rotation between the perforating gun 110*a* and the perforating gun 110*b*, as indicated by arrow 365.

Figure 9B:
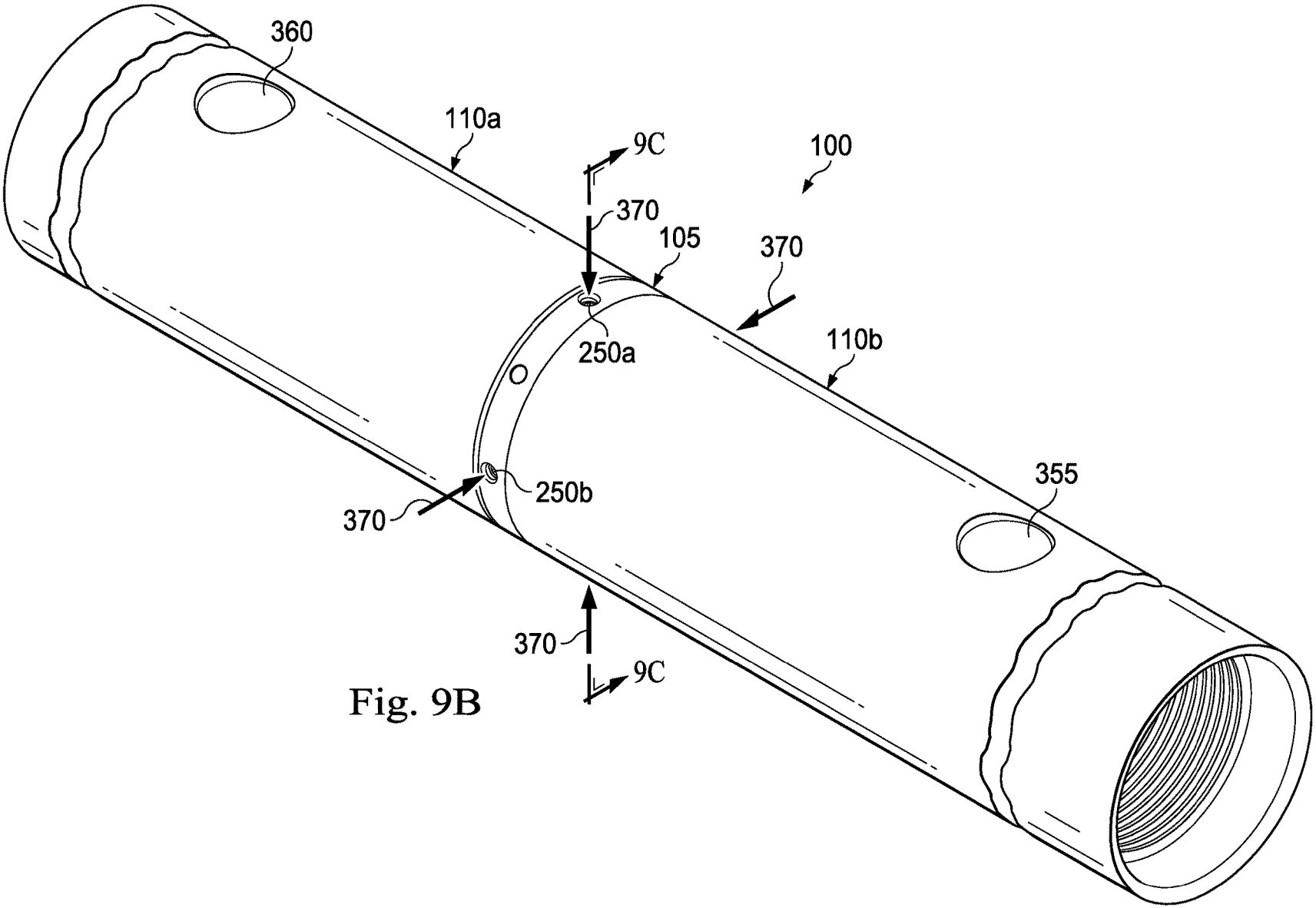
FIG. 9B is a perspective view of FIG. 1 wellbore perforating system in a second operational state or configuration, according to one or more embodiments.

Referring to FIG. 9B, with continuing reference to FIGS. 1-8, a perspective view of the wellbore perforating system 100 in a second operational state or configuration is illustrated according to an embodiment of the present disclosure. In the second operational state or configuration: the perforating gun 110*a* is connected to orienting sub 105 at the hub retainer 115, as will be described in further detail below in connection with FIG. 9C; the perforating gun 110*b* is connected to the orienting sub 105 at the gun sleeve 120, as will be described in further detail below in connection with FIG. 9C; the scallop recess 355 of the perforating gun 110*b* is circumferentially aligned with the scallop recess 360 of the perforating gun 110*a*; and the set screws 255*a-d* are tightened into the threaded holes 250*a-d*, respectively, as indicated by arrows 370. Because of the set screws 255*a-d* being tightened into the threaded holes 250*a-d*, respectively, in the second operational state or configuration, the orienting sub 105 does not permit relative rotation between the perforating gun 110*a* and the perforating gun 110*b*.

Figure 9C:
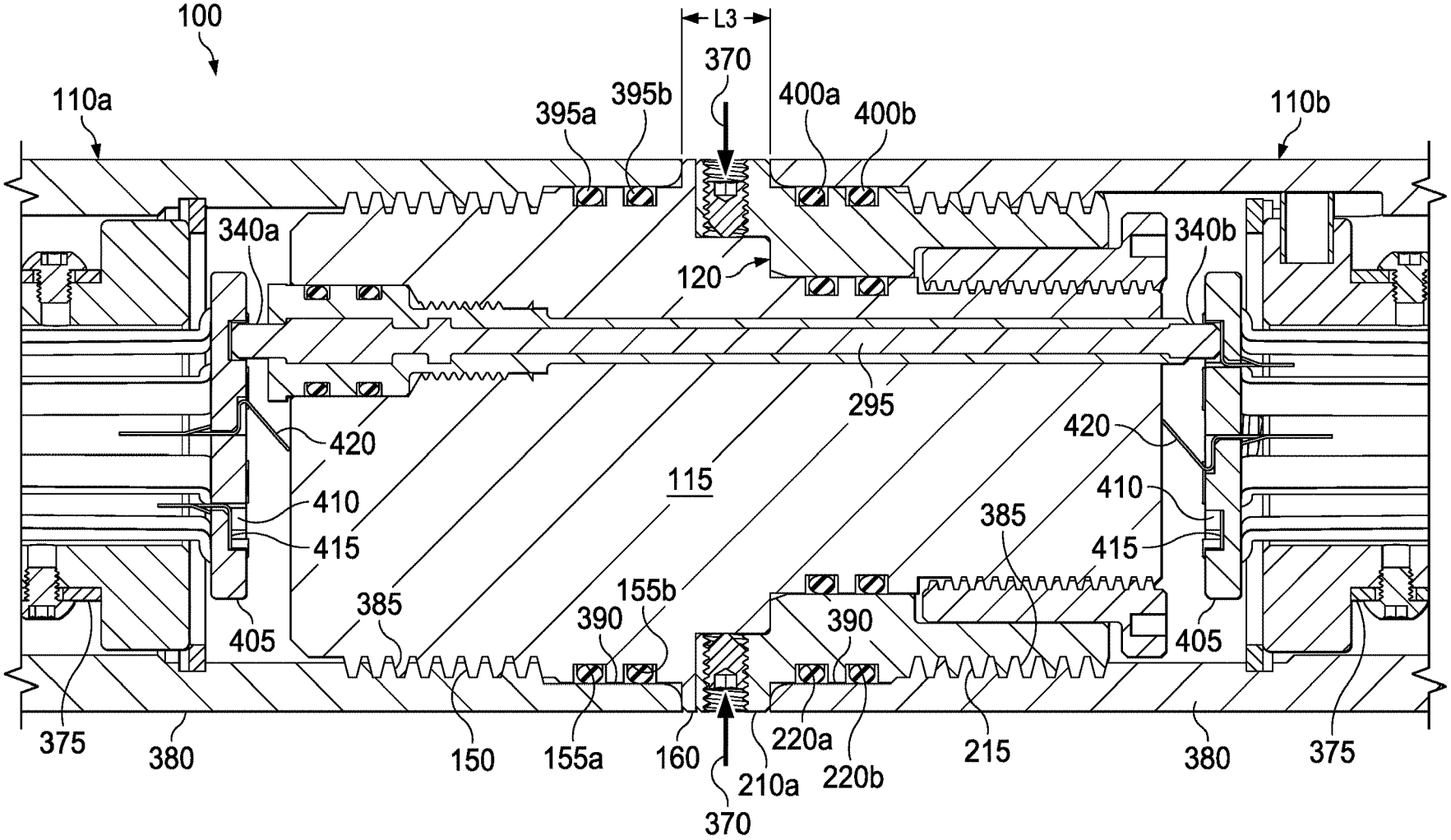
FIG. 9C is a cross-sectional view of FIG. 1 wellbore perforating system in the second operational state or configuration taken along the line 9C-9C of FIG. 9B, according to one or more embodiments.

Referring to FIG. 9C, with continuing reference to FIGS. 1-8, a cross-sectional view of the wellbore perforating system 100 in the second operational state or configuration taken along the line 9C-9C of FIG. 9B is illustrated according to an embodiment of the present disclosure. The perforating guns 110*a* and 110*b* each include a charge tube 375 accommodated within a carrier tube 380, which carrier tube 380 includes an internal threaded connection 385 and an internal sealing surface 390. The internal threaded connection 385 of the perforating gun 110*a* is threadably engaged with the external threaded connection 150 of the hub retainer 115 so that the carrier tube 380 of the perforating gun 110*a* engages (or nearly engages) the collar 160 extending outwardly from the enlarged-diameter portion 145*a* of the hub retainer 115. Annular seals 395*a* and 395*b* are accommodated in the external annular grooves 155*a* and 155*b* of the hub retainer 115, which annular seals 395*a* and 395*b* sealingly engage the internal sealing surface 390 of the perforating gun 110*a*. Likewise, the internal threaded connection 385 of the perforating gun 110*b* is threadably engaged with the external threaded connection 215 of the gun sleeve 120 so that the carrier tube 380 of the perforating gun 110*b* engages (or nearly engages) the enlarged-diameter portion 210*a* of the gun sleeve 120. In several embodiments, the spanner holes 245*a* and 245*b* are engaged by a spanner wrench to facilitate the threaded engagement of the internal threaded connection 385 of the perforating gun 110*b* with the external threaded connection 215 of the gun sleeve 120. Annular seals 400*a* and 400*b* are accommodated in the external annular grooves 220*a* and 220*b* of the gun sleeve 120, which annular seals 400*a* and 400*b* sealingly engage the internal sealing surface 390 of the perforating gun 110*b*. Tightening the set screws 255*a-d* into the threaded holes 250*a-d*, respectively, as indicated by the arrows 370, causes the set screws 255*a-d* to "bite" into the setting surface 151 of the hub retainer 115 to thereby prevent, or at least resist, relative rotation between the gun sleeve 120 and the hub retainer 115 (and thus between the perforating guns 110*a* and 110*b*). The perforating gun 110*b* is separated from the perforating gun 110*a* by an axial length L3.

In addition to the charge tube 375 and the carrier tube 380, the perforating guns 110*a* and 110*b* each include an electric conductor hub 405 operably coupled to the charge tube 375. An annular groove 410 is formed into the electric conductor hub 405. A circumferentially-extending (e.g., annular) electric conductor 415 is accommodated within the annular groove 410. A ground conductor 420 also extends from the electric conductor hub 405. The end portion 340*a* of the electrical conductor 295 extends within the annular groove 410 of the perforating gun 110*a* and contacts the circumferentially-extending electric conductor 415 of the perforating gun 110*a*. The contact between the end portion 340*a* of the electrical conductor 295 and the circumferentially-extending electric conductor 415 of the perforating gun 110*a* establishes electrical communication while still allowing relative rotation therebetween (e.g., to facilitate alignment of the scallop recesses 355 and 360, the threaded engagement of the internal threaded connection 385 of the perforating gun 110*a* with the external threaded connection 150 of the hub retainer 115, or the like). The ground conductor 420 extending from the electric conductor hub 405 of the perforating gun 110*a* contacts the hub retainer 115 of the orienting sub 105.

Similarly, the end portion 340*b* of the electrical conductor 295 extends within the annular groove 410 of the perforating gun 110*b* and contacts the circumferentially-extending electric conductor 415 of the perforating gun 110*b*. The contact between the end portion 340*b* of the electrical conductor 295 and the circumferentially-extending electric conductor 415 of the perforating gun 110*b* establishes electrical communication while still allowing relative rotation therebetween (e.g., to facilitate alignment of the scallop recesses 355 and 360, the threaded engagement of the internal threaded connection 385 of the perforating gun 110*b* with the external threaded connection 215 of the gun sleeve 120, or the like). The ground conductor 420 extending from the electric conductor hub 405 of the perforating gun 110*b* contacts the hub retainer 115 of the orienting sub 105. In operation, the perforating guns 110*a* and 110*b* establish electrical communication therebetween via the contact between the end portion 340*a* of the electrical conductor 295 and the circumferentially-extending electric conductor 415 of the perforating gun 110*a*, the electrical conductor 295, and the contact between the end portion 340*b* of the electrical conductor 295 and the circumferentially-extending electric conductor 415 of the perforating gun 110*b*.

In several embodiments, the axial length L2 is greater than the axial length L1. In several embodiments, the outer diameter D2 is equal to the outer diameter D1. In several embodiments, the axial length L1 is less than the outer diameter D1. For example, a ratio of the axial length L1 to the outer diameter D1 may be less than or equal to: 0.1, 0.2, 0.3, 0.4, 0.5, 0.6, 0.7, 0.8, 0.9, or 1. In addition, or instead, a ratio of the axial length L1 to the outer diameter D1 may be greater than or equal to: 0, 0.1, 0.2, 0.3, 0.4, 0.5, 0.6, 0.7, 0.8, or 0.9.

In several embodiments, the axial length L2 is less than the outer diameter D2. For example, a ratio of the axial length L2 to the outer diameter D2 may be less than or equal to: 0.1, 0.2, 0.3, 0.4, 0.5, 0.6, 0.7, 0.8, 0.9, or 1. In addition, or instead, a ratio of the axial length L2 to the outer diameter D2 may be greater than or equal to: 0, 0.1, 0.2, 0.3, 0.4, 0.5, 0.6, 0.7, 0.8, or 0.9.

In several embodiments, a sum of the axial lengths L1 and L2 is less than the outer diameter D1. For example, a ratio of the sum of the axial lengths L1 and L2 to the outer diameter D1 may be less than or equal to: 0.1, 0.2, 0.3, 0.4, 0.5, 0.6, 0.7, 0.8, 0.9, or 1. In addition, or instead, a ratio of the sum of the axial lengths L1 and L2 to the outer diameter D1 may be greater than or equal to: 0, 0.1, 0.2, 0.3, 0.4, 0.5, 0.6, 0.7, 0.8, or 0.9.

In several embodiments, a sum of the axial lengths L1 and L2 is less than the outer diameter D2. For example, a ratio of the sum of the axial lengths L1 and L2 to the outer diameter D2 may be less than or equal to: 0.1, 0.2, 0.3, 0.4, 0.5, 0.6, 0.7, 0.8, 0.9, or 1. In addition, or instead, a ratio of the sum of the axial lengths L1 and L2 to the outer diameter D2 may be greater than or equal to: 0, 0.1, 0.2, 0.3, 0.4, 0.5, 0.6, 0.7, 0.8, or 0.9.

In several embodiments, the axial length L2 is greater than the inner diameter D3. For example, a ratio of the axial length L2 to the inner diameter D3 may be equal to or less than: 1.1, 1.2, 1.3, 1.4, 1.5, 1.6, 1.7, 1.8, 1.9, 2, 3, 4, 5, 6, 7, 8, 9, 10, 12, 14, 16, 18, 20, 25, or 30. In addition, or instead, a ratio of the axial length L2 to the inner diameter D3 may be greater than, or equal to: 1, 1.1, 1.2, 1.3, 1.4, 1.5, 1.6, 1.7, 1.8, 1.9, 2, 3, 4, 5, 6, 7, 8, 9, 10, 12, 14, 16, 18, 20, or 25.

In several embodiments, the axial length L3 is less than the outer diameter D1. For example, a ratio of the axial length L3 to the outer diameter D1 may be less than or equal to: 0.1, 0.2, 0.3, 0.4, 0.5, 0.6, 0.7, 0.8, 0.9, or 1. In addition, or instead, a ratio of the axial length L3 to the outer diameter D1 may be greater than or equal to: 0, 0.1, 0.2, 0.3, 0.4, 0.5, 0.6, 0.7, 0.8, or 0.9.

In several embodiments, the axial length L3 is less than the outer diameter D2. For example, a ratio of the axial length L3 to the outer diameter D2 may be less than or equal to: 0.1, 0.2, 0.3, 0.4, 0.5, 0.6, 0.7, 0.8, 0.9, or 1. In addition, or instead, a ratio of the axial length L3 to the outer diameter D2 may be greater than or equal to: 0, 0.1, 0.2, 0.3, 0.4, 0.5, 0.6, 0.7, 0.8, or 0.9.

Various features/components of the wellbore perforating system 100 have been described herein as having external annular groove(s) formed therein to accommodate annular seal(s) for sealingly engaging an adjacent surface; however, in every such instance described herein, the external annular groove(s) may be omitted and replaced with internal annular groove(s) in said adjacent surface for accommodating the corresponding annular seal(s).

Although described herein as selectively permitting and preventing (or at least reducing) relative rotation between the perforating guns 110*a* and 110*b*, the orienting sub 105 of the present disclosure is suited to other downhole tools as well; thus, one or both of the perforating guns 110*a* and 110*b* may be omitted and replaced with other downhole tool(s).

The present disclosure introduces a system. The system generally includes: an orienting sub, including: a hub retainer defining opposing first and second end portions; a first sleeve extending around the hub retainer at the first end portion; and a second sleeve connected to the hub retainer at the first end portion to hold the first sleeve on the hub retainer; a first downhole tool connected to the first sleeve; and a second downhole tool connected to the hub retainer at the second end portion; wherein the system is actuable between: a first configuration, in which relative rotation between the first sleeve and the hub retainer, and thus between the first downhole tool and the second downhole tool, is permitted; and a second configuration, in which relative rotation between the first sleeve and the hub retainer, and thus between the first downhole tool and the second downhole tool, is prevented, or at least resisted. In one or more embodiments, the first sleeve includes an enlarged-diameter portion extending between the first downhole tool and the second downhole tool; and the first and second downhole tools are spaced apart from each other by at least an axial length of the enlarged-diameter portion. In one or more embodiments, the orienting sub further includes: a set screw; and a threaded hole formed radially through the enlarged-diameter portion of the first sleeve; and, in the second configuration, the set screw bites into the hub retainer to prevent, or at least resist, the relative rotation between the first sleeve and the hub retainer. In one or more embodiments, the hub retainer includes an external collar extending between the first downhole tool and the second downhole tool; and the first and second downhole tools are spaced apart from each other by at least an axial length of the external collar. In one or more embodiments, the orienting sub further includes an electric conductor assembly extending within an internal passageway of the hub retainer; and the first and second downhole tools include first and second electric conductors, respectively, in contact with the electric conductor assembly to establish electrical communication between the first downhole tool and the second downhole tool. In one or more embodiments, the electric conductor assembly extends along a first central axis, which first central axis is offset from a second central axis of the hub retainer; and the first electric conductor extends circumferentially about a third central axis of the first downhole tool to permit the relative rotation between the first sleeve and the hub retainer in the first configuration. In one or more embodiments, the orienting sub further includes a seal that sealingly engages the first sleeve and the hub retainer while permitting the relative rotation between the first sleeve and the hub retainer in the first configuration. In one or more embodiments, the first downhole tool is or includes a first perforating gun; the second downhole tool is or includes a second perforating gun; or the first downhole tool is or includes the first perforating gun and the second downhole tool is or includes the second perforating gun.

The present disclosure also introduces a method. The method generally includes: rotating, while an orienting sub connecting a first downhole tool to a second downhole tool is in a first configuration in which relative rotation between the first downhole tool and the second downhole tool is permitted, the first downhole tool relative to the second downhole tool, or vice versa; wherein the orienting sub includes: a hub retainer defining opposing first and second end portions; a first sleeve extending around the hub retainer at the first end portion; and a second sleeve connected to the hub retainer at the first end portion to hold the first sleeve on the hub retainer; wherein the first downhole tool is connected to the first sleeve; wherein the second downhole tool is connected to the second end portion of the hub retainer; and wherein in the first configuration, relative rotation between the first sleeve and the hub retainer is permitted to thereby permit the relative rotation between the first downhole tool and the second downhole tool; and actuating the orienting sub from the first configuration to a second configuration in which relative rotation between the first sleeve and the hub retainer, and thus between the first downhole tool and the second downhole tool, is prevented, or at least resisted. In one or more embodiments, the first sleeve includes an enlarged-diameter portion extending between the first downhole tool and the second downhole tool; and the first and second downhole tools are spaced apart from each other by at least an axial length of the enlarged-diameter portion. In one or more embodiments, the orienting sub further includes: a set screw; and a threaded hole formed radially through the enlarged-diameter portion of the first sleeve; and actuating the orienting sub from the first configuration to the second configuration includes tightening the set screw into the threaded hole, causing the set screw to bite into the hub retainer. In one or more embodiments, the hub retainer includes an external collar extending between the first downhole tool and the second downhole tool; and the first and second downhole tools are spaced apart from each other by at least an axial length of the external collar. In one or more embodiments, the orienting sub further includes an electric conductor assembly extending within an internal passageway of the hub retainer; and the first and second downhole tools include first and second electric conductors, respectively, in contact with the electric conductor assembly to establish electrical communication between the first downhole tool and the second downhole tool. In one or more embodiments, the electric conductor assembly extends along a first central axis, which first central axis is offset from a second central axis of the hub retainer; and the first electric conductor extends circumferentially about a third central axis of the first downhole tool to permit the relative rotation between the first sleeve and the hub retainer in the first configuration. In one or more embodiments, rotating the first downhole tool relative to the second downhole tool, or vice versa, includes sealingly engaging the first sleeve and the hub retainer while permitting the relative rotation between the first sleeve and the hub retainer. In one or more embodiments, the first downhole tool is or includes a first perforating gun; the second downhole tool is or includes a second perforating gun; or wherein the first downhole tool is or includes the first perforating gun and the second downhole tool is or includes the second perforating gun.

The present disclosure also introduces an apparatus to connect a first downhole tool to a second downhole tool. The apparatus generally includes: a hub retainer defining a first end portion, to which the first downhole tool is connectable, and an opposing second end portion; a first sleeve, to which the second downhole tool is connectable, which first sleeve is adapted to extend around the hub retainer at the first end portion; and a second sleeve adapted to be connected to the hub retainer at the first end portion to hold the first sleeve on the hub retainer; wherein, when the first sleeve extends around the hub retainer at the first end portion and the second sleeve is connected to the hub retainer at the first end portion to hold the first sleeve on the hub retainer, the apparatus is actuable between: a first configuration, in which relative rotation between the first sleeve and the hub retainer is permitted; and a second configuration, in which relative rotation between the first sleeve and the hub retainer is prevented, or at least resisted. In one or more embodiments, the first sleeve includes an enlarged-diameter portion adapted to extend between the first downhole tool and the second downhole tool to thereby space apart the first downhole tool from the second downhole tool by at least an axial length of the enlarged-diameter portion when the apparatus connects the first downhole tool to the second downhole tool. In one or more embodiments, the apparatus further includes: a set screw; and a threaded hole formed radially through the enlarged-diameter portion of the first sleeve; wherein the set screw is adapted to bite into the hub retainer in the second configuration to prevent, or at least resist, the relative rotation between the first sleeve and the hub retainer. In one or more embodiments, the hub retainer includes an external collar adapted to extend between the first downhole tool and the second downhole tool to thereby space apart the first downhole tool from the second downhole tool by at least an axial length of the external collar when the apparatus connects the first downhole tool to the second downhole tool. In one or more embodiments, the apparatus further includes a seal adapted to sealingly engage the first sleeve and the hub retainer while permitting the relative rotation between the first sleeve and the hub retainer in the first configuration.

It is understood that variations may be made in the foregoing without departing from the scope of the present disclosure.

In several embodiments, the elements and teachings of the various embodiments may be combined in whole or in part in some or all of the embodiments. In addition, one or more of the elements and teachings of the various embodiments may be omitted, at least in part, and/or combined, at least in part, with one or more of the other elements and teachings of the various embodiments.

Any spatial references, such as, for example, "upper," "lower," "above," "below," "between," "bottom," "vertical," "horizontal," "angular," "upwards," "downwards," "side-to-side," "left-to-right," "right-to-left," "top-to-bottom," "bottom-to-top," "top," "bottom," "bottom-up," "top-down," etc., are for the purpose of illustration only and do not limit the specific orientation or location of the structure described above.

In several embodiments, while different steps, processes, and procedures are described as appearing as distinct acts, one or more of the steps, one or more of the processes, and/or one or more of the procedures may also be performed in different orders, simultaneously and/or sequentially. In several embodiments, the steps, processes, and/or procedures may be merged into one or more steps, processes and/or procedures.

In several embodiments, one or more of the operational steps in each embodiment may be omitted. Moreover, in some instances, some features of the present disclosure may be employed without a corresponding use of the other features. Moreover, one or more of the above-described embodiments and/or variations may be combined in whole or in part with any one or more of the other above-described embodiments and/or variations.

Although several embodiments have been described in detail above, the embodiments described are illustrative only and are not limiting, and those skilled in the art will readily appreciate that many other modifications, changes and/or substitutions are possible in the embodiments without materially departing from the novel teachings and advantages of the present disclosure. Accordingly, all such modifications, changes, and/or substitutions are intended to be included within the scope of this disclosure as defined in the following claims. In the claims, any means-plus-function clauses are intended to cover the structures described herein as performing the recited function and not only structural equivalents, but also equivalent structures. Moreover, it is the express intention of the applicant not to invoke 35 U.S.C. § 112(f) for any limitations of any of the claims herein, except for those in which the claim expressly uses the word "means" together with an associated function.

What is claimed is:

1. A system, comprising:

an orienting sub, comprising:

a hub retainer defining opposing first and second end portions; and a first sleeve extending around the hub retainer at the first end portion;

a first downhole tool connected to the first sleeve; and a second downhole tool connected to the hub retainer at the second end portion;

wherein the system is actuable between:

a first configuration, in which relative rotation between the first sleeve and the hub retainer, and thus between the first downhole tool and the second downhole tool, is permitted; and a second configuration, in which relative rotation between the first sleeve and the hub retainer, and thus between the first downhole tool and the second downhole tool, is prevented, or at least resisted;

and wherein the first sleeve is located in the same axial position relative to the hub retainer in both the first configuration and the second configuration.

2. The system of claim 1, wherein the first sleeve includes an enlarged-diameter portion extending between the first downhole tool and the second downhole tool; and wherein the first and second downhole tools are spaced apart from each other by at least an axial length of the enlarged-diameter portion.

3. The system of claim 1, wherein the hub retainer includes an external collar extending between the first downhole tool and the second downhole tool; and wherein the first and second downhole tools are spaced apart from each other by at least an axial length of the external collar.

4. The system of claim 1, wherein the orienting sub further comprises an electric conductor assembly extending within an internal passageway of the hub retainer; and wherein the first and second downhole tools comprise first and second electric conductors, respectively, in contact with the electric conductor assembly to establish electrical communication between the first downhole tool and the second downhole tool.

5. The system of claim 1, wherein the orienting sub further comprises a seal that sealingly engages the first sleeve and the hub retainer while permitting the relative rotation between the first sleeve and the hub retainer in the first configuration.

6. The system of claim 1, wherein the first downhole tool is or includes a first perforating gun;

wherein the second downhole tool is or includes a second perforating gun; or wherein the first downhole tool is or includes the first perforating gun and the second downhole tool is or includes the second perforating gun.

7. The system of claim 1, wherein the orienting sub further comprises:

a second sleeve connected to the hub retainer at the first end portion to hold the first sleeve on the hub retainer.

8. A system, comprising:

an orienting sub, comprising:

a hub retainer defining opposing first and second end portions;

a first sleeve extending around the hub retainer at the first end portion; and a second sleeve connected to the hub retainer at the first end portion to hold the first sleeve on the hub retainer;

a first downhole tool connected to the first sleeve; and a second downhole tool connected to the hub retainer at the second end portion;

wherein the system is actuable between:

a first configuration, in which relative rotation between the first sleeve and the hub retainer, and thus between the first downhole tool and the second downhole tool, is permitted; and a second configuration, in which relative rotation between the first sleeve and the hub retainer, and thus between the first downhole tool and the second downhole tool, is prevented, or at least resisted;

wherein the first sleeve includes an enlarged-diameter portion extending between the first downhole tool and the second downhole tool;

wherein the first and second downhole tools are spaced apart from each other by at least an axial length of the enlarged-diameter portion;

wherein the orienting sub further comprises:

a set screw; and a threaded hole formed radially through the enlarged-diameter portion of the first sleeve;

and wherein, in the second configuration, the set screw bites into the hub retainer to prevent, or at least resist, the relative rotation between the first sleeve and the hub retainer.

9. A system, comprising:

an orienting sub, comprising:

a hub retainer defining opposing first and second end portions;

a first sleeve extending around the hub retainer at the first end portion; and a second sleeve connected to the hub retainer at the first end portion to hold the first sleeve on the hub retainer;

a first downhole tool connected to the first sleeve; and a second downhole tool connected to the hub retainer at the second end portion;

wherein the system is actuable between:

a first configuration, in which relative rotation between the first sleeve and the hub retainer, and thus between the first downhole tool and the second downhole tool, is permitted; and a second configuration, in which relative rotation between the first sleeve and the hub retainer, and thus between the first downhole tool and the second downhole tool, is prevented, or at least resisted;

wherein the orienting sub further comprises an electric conductor assembly extending within an internal passageway of the hub retainer;

wherein the first and second downhole tools comprise first and second electric conductors, respectively, in contact with the electric conductor assembly to establish electrical communication between the first downhole tool and the second downhole tool;

wherein the electric conductor assembly extends along a first central axis, which first central axis is offset from a second central axis of the hub retainer; and wherein the first electric conductor extends circumferentially about a third central axis of the first downhole tool to permit the relative rotation between the first sleeve and the hub retainer in the first configuration.

10. A method, comprising:

rotating, while an orienting sub connecting a first downhole tool to a second downhole tool is in a first configuration in which relative rotation between the first downhole tool and the second downhole tool is permitted, the first downhole tool relative to the second downhole tool, or vice versa;

wherein the orienting sub comprises:

a hub retainer defining opposing first and second end portions; and a first sleeve extending around the hub retainer at the first end portion;

wherein the first downhole tool is connected to the first sleeve;

wherein the second downhole tool is connected to the second end portion of the hub retainer; and wherein in the first configuration, relative rotation between the first sleeve and the hub retainer is permitted to thereby permit the relative rotation between the first downhole tool and the second downhole tool;

and actuating the orienting sub from the first configuration to a second configuration in which relative rotation between the first sleeve and the hub retainer, and thus between the first downhole tool and the second downhole tool, is prevented, or at least resisted;

wherein the first sleeve is located in the same axial position relative to the hub retainer in both the first configuration and the second configuration.

11. The method of claim 10, wherein the first sleeve includes an enlarged-diameter portion extending between the first downhole tool and the second downhole tool; and wherein the first and second downhole tools are spaced apart from each other by at least an axial length of the enlarged-diameter portion.

12. The method of claim 10, wherein the hub retainer includes an external collar extending between the first downhole tool and the second downhole tool; and wherein the first and second downhole tools are spaced apart from each other by at least an axial length of the external collar.

13. The method of claim 10, wherein the orienting sub further comprises an electric conductor assembly extending within an internal passageway of the hub retainer; and wherein the first and second downhole tools comprise first and second electric conductors, respectively, in contact with the electric conductor assembly to establish electrical communication between the first downhole tool and the second downhole tool.

14. The method of claim 10, wherein rotating the first downhole tool relative to the second downhole tool, or vice versa, comprises sealingly engaging the first sleeve and the hub retainer while permitting the relative rotation between the first sleeve and the hub retainer.

15. The method of claim 10, wherein the first downhole tool is or includes a first perforating gun;

wherein the second downhole tool is or includes a second perforating gun; or wherein the first downhole tool is or includes the first perforating gun and the second downhole tool is or includes the second perforating gun.

16. The method of claim 10, wherein the orienting sub further comprises:

a second sleeve connected to the hub retainer at the first end portion to hold the first sleeve on the hub retainer.

17. A method, comprising:

rotating, while an orienting sub connecting a first downhole tool to a second downhole tool is in a first configuration in which relative rotation between the first downhole tool and the second downhole tool is permitted, the first downhole tool relative to the second downhole tool, or vice versa;

wherein the orienting sub comprises:

a hub retainer defining opposing first and second end portions;

a first sleeve extending around the hub retainer at the first end portion; and a second sleeve connected to the hub retainer at the first end portion to hold the first sleeve on the hub retainer;

wherein the first downhole tool is connected to the first sleeve;

wherein the second downhole tool is connected to the second end portion of the hub retainer; and wherein in the first configuration, relative rotation between the first sleeve and the hub retainer is permitted to thereby permit the relative rotation between the first downhole tool and the second downhole tool:

and actuating the orienting sub from the first configuration to a second configuration in which relative rotation between the first sleeve and the hub retainer, and thus between the first downhole tool and the second downhole tool, is prevented, or at least resisted;

wherein the first sleeve includes an enlarged-diameter portion extending between the first downhole tool and the second downhole tool;

wherein the first and second downhole tools are spaced apart from each other by at least an axial length of the enlarged-diameter portion;

wherein the orienting sub further comprises:

a set screw; and a threaded hole formed radially through the enlarged-diameter portion of the first sleeve;

and wherein actuating the orienting sub from the first configuration to the second configuration comprises tightening the set screw into the threaded hole, causing the set screw to bite into the hub retainer.

18. A method, comprising:

rotating, while an orienting sub connecting a first downhole tool to a second downhole tool is in a first configuration in which relative rotation between the first downhole tool and the second downhole tool is permitted, the first downhole tool relative to the second downhole tool, or vice versa;

wherein the orienting sub comprises:

a hub retainer defining opposing first and second end portions;

a first sleeve extending around the hub retainer at the first end portion; and a second sleeve connected to the hub retainer at the first end portion to hold the first sleeve on the hub retainer;

wherein the first downhole tool is connected to the first sleeve;

wherein the second downhole tool is connected to the second end portion of the hub retainer; and wherein in the first configuration, relative rotation between the first sleeve and the hub retainer is permitted to thereby permit the relative rotation between the first downhole tool and the second downhole tool;

and actuating the orienting sub from the first configuration to a second configuration in which relative rotation between the first sleeve and the hub retainer, and thus between the first downhole tool and the second downhole tool, is prevented, or at least resisted;

wherein the orienting sub further comprises an electric conductor assembly extending within an internal passageway of the hub retainer;

wherein the first and second downhole tools comprise first and second electric conductors, respectively, in contact with the electric conductor assembly to establish electrical communication between the first downhole tool and the second downhole tool;

wherein the electric conductor assembly extends along a first central axis, which first central axis is offset from a second central axis of the hub retainer; and wherein the first electric conductor extends circumferentially about a third central axis of the first downhole tool to permit the relative rotation between the first sleeve and the hub retainer in the first configuration.

19. An apparatus adapted to connect a first downhole tool to a second downhole tool, the apparatus comprising:

a hub retainer defining a first end portion, to which the first downhole tool is connectable, and an opposing second end portion; and a first sleeve, to which the second downhole tool is connectable, which first sleeve is adapted to extend around the hub retainer at the first end portion;

wherein, when the first sleeve extends around the hub retainer at the first end portion, the apparatus is actuable between:

a first configuration, in which relative rotation between the first sleeve and the hub retainer is permitted; and a second configuration, in which relative rotation between the first sleeve and the hub retainer is prevented, or at least resisted;

and wherein the first sleeve is located in the same axial position relative to the hub retainer in both the first configuration and the second configuration.

20. The apparatus of claim 19, wherein the first sleeve includes an enlarged-diameter portion adapted to extend between the first downhole tool and the second downhole tool to thereby space apart the first downhole tool from the second downhole tool by at least an axial length of the enlarged-diameter portion when the apparatus connects the first downhole tool to the second downhole tool.

21. The apparatus of claim 19, wherein the hub retainer includes an external collar adapted to extend between the first downhole tool and the second downhole tool to thereby space apart the first downhole tool from the second downhole tool by at least an axial length of the external collar when the apparatus connects the first downhole tool to the second downhole tool.

22. The apparatus of claim 19, wherein the apparatus further comprises a seal adapted to sealingly engage the first sleeve and the hub retainer while permitting the relative rotation between the first sleeve and the hub retainer in the first configuration.

23. The apparatus of claim 19, further comprising:

a second sleeve adapted to be connected to the hub retainer at the first end portion to hold the first sleeve on the hub retainer;

wherein, when the first sleeve extends around the hub retainer at the first end portion and the second sleeve is connected to the hub retainer at the first end portion to hold the first sleeve on the hub retainer, the apparatus is actuable between the first configuration and the second configuration.

24. An apparatus adapted to connect a first downhole tool to a second downhole tool, the apparatus comprising:

a hub retainer defining a first end portion, to which the first downhole tool is connectable, and an opposing second end portion;

a first sleeve, to which the second downhole tool is connectable, which first sleeve is adapted to extend around the hub retainer at the first end portion; and a second sleeve adapted to be connected to the hub retainer at the first end portion to hold the first sleeve on the hub retainer;

wherein, when the first sleeve extends around the hub retainer at the first end portion and the second sleeve is connected to the hub retainer at the first end portion to hold the first sleeve on the hub retainer, the apparatus is actuable between:

a first configuration, in which relative rotation between the first sleeve and the hub retainer is permitted; and a second configuration, in which relative rotation between the first sleeve and the hub retainer is prevented, or at least resisted;

wherein the first sleeve includes an enlarged-diameter portion adapted to extend between the first downhole tool and the second downhole tool to thereby space apart the first downhole tool from the second downhole tool by at least an axial length of the enlarged-diameter portion when the apparatus connects the first downhole tool to the second downhole tool;

wherein the apparatus further comprises:

a set screw; and a threaded hole formed radially through the enlarged-diameter portion of the first sleeve;

and wherein the set screw is adapted to bite into the hub retainer in the second configuration to prevent, or at least resist, the relative rotation between the first sleeve and the hub retainer.

* * * * *